US010530080B2

(12) United States Patent
Kuo et al.

(10) Patent No.: US 10,530,080 B2
(45) Date of Patent: Jan. 7, 2020

(54) ELECTRONIC DEVICE

(71) Applicant: PEGATRON CORPORATION, Taipei (TW)

(72) Inventors: Yu-Ti Kuo, Taipei (TW); Yen-Hsing Chu, Taipei (TW); Chien-Yi Lee, Taipei (TW); Ching-Jen Wang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/034,152

(22) Filed: Jul. 12, 2018

(65) Prior Publication Data

US 2019/0067852 A1 Feb. 28, 2019

(30) Foreign Application Priority Data

Aug. 30, 2017 (TW) ..... 106129420 A

(51) Int. Cl.

| | |
|---|---|
| ***H01R 12/71*** | (2011.01) |
| ***H01R 13/648*** | (2006.01) |
| ***H01R 4/66*** | (2006.01) |
| ***H01R 4/56*** | (2006.01) |

(52) U.S. Cl.

CPC ..... *H01R 12/714* (2013.01); *H01R 4/56* (2013.01); *H01R 4/66* (2013.01); *H01R 13/6485* (2013.01)

(58) Field of Classification Search

CPC ..... H05K 1/0215; H05K 2201/10409; H05K 7/142; H05K 9/0039; H05K 1/115; H01L 2023/4087; H01L 23/4006

See application file for complete search history.

(56) References Cited

U.S. PATENT DOCUMENTS 4,927,367 A * 5/1990 Salvagno ..... H05K 9/0039 200/507
5,326,937 A * 7/1994 Watanabe ..... H05K 1/0215 174/262
5,420,378 A * 5/1995 Estes ..... H05K 1/0215 174/261

(Continued)

FOREIGN PATENT DOCUMENTS

TW 201123995 7/2011
TW M471731 2/2014

*Primary Examiner* — Edwin A. Leon
*Assistant Examiner* — Matthew T Dzierzynski
(74) *Attorney, Agent, or Firm* — J.C. Patents

(57) ABSTRACT

An electronic device includes a ground element, a conductive assembly, a circuit board, an insulating element and a conductive element. The conductive assembly includes a base and a screw element. The base is disposed at the ground element and contacts the ground element. The screw element has a fixing portion and a clamping portion connected to the fixing portion. The outer diameter of the clamping portion is larger than the outer diameter of the fixing portion, and the fixing portion is fixed to the base. The circuit board is disposed between the base and the clamping portion of the screw element. The insulating element is disposed between part of the clamping portion and the circuit board. The conductive element is disposed at the circuit board and contacts the conductive assembly. The circuit board is electrically connected to the ground element through the conductive element and the conductive assembly.

9 Claims, 3 Drawing Sheets

(56) References Cited

U.S. PATENT DOCUMENTS

| | | | | |
|---|---|---|---|---|
| 5,463,229 | A * | 10/1995 | Takase | H01L 25/042 257/434 |
| 6,493,233 | B1 * | 12/2002 | De Lorenzo | H05K 3/325 174/138 G |
| 6,706,964 | B2 * | 3/2004 | Igarashi | H05K 1/0218 174/250 |
| 6,921,288 | B2 * | 7/2005 | Blondin | H01R 31/08 439/134 |
| 7,333,347 | B1 * | 2/2008 | Liang | H05K 7/142 174/177 |
| 8,013,529 | B2 * | 9/2011 | Kang | H05K 7/20972 313/582 |
| 8,077,472 | B2 * | 12/2011 | Liu | H05K 1/0215 174/257 |
| 8,159,833 | B2 * | 4/2012 | Ishii | H05K 1/0215 174/262 |
| 8,358,491 | B2 * | 1/2013 | Chen | H05K 1/0215 361/117 |
| 8,432,702 | B2 * | 4/2013 | Hasegawa | H05K 1/0215 174/262 |
| 8,553,387 | B2 * | 10/2013 | Wang | H05K 9/0067 361/212 |
| 9,007,779 | B2 * | 4/2015 | Yamamoto | G11B 25/043 361/752 |
| 9,113,567 | B2 * | 8/2015 | Stotz, Jr. | F16B 5/0241 |
| 9,848,511 | B2 * | 12/2017 | Umeno | H05K 7/20409 |
| 9,861,314 | B2 * | 1/2018 | Haverinen | A61B 5/6801 |
| 10,001,591 | B2 * | 6/2018 | Guiset | G02B 19/0047 |
| 10,178,759 | B2 * | 1/2019 | Lim | H02M 1/44 |

* cited by examiner

ELECTRONIC DEVICE

CROSS-REFERENCE TO RELATED APPLICATION

This application claims the priority benefit of Taiwan application serial no. 106129420, filed on Aug. 30, 2017. The entirety of the above-mentioned patent application is hereby incorporated by reference herein and made a part of this specification.

BACKGROUND

Technical Field

The present disclosure relates to an electronic device, more particularly, to an electronic device capable of preventing the accumulation of static electricity.

Description of Related Art

The both sides of the conventional circuit board has bare coppers for electrostatic discharge, and the bare coppers of the circuit board are further coupled to main frame made of metal by screwing, so as to connect to the ground. However, the bare coppers disposed at both sides occupy a lot of wiring space of the circuit board, so that this method does not conform to the design trend toward lighter circuit board.

With the popularity of electronic devices, the consumer gradually pays attention to not only the function of the electronic device, but also the appearance and texture of the electronic device. In order to improve the visual effect, the electronic device in the market has a light guiding element installed on the circuit board, thereby improve the visual enjoyment of the user.

However, installing the light guiding element on the circuit board may cause two problems: one of the problems is that, when a hole is formed on the circuit board form to lock the light guide element, reducing the space for wiring on the circuit board is inevitable, thus the size of the circuit board cannot be effectively reduced. Another problem is that, when the insulating light guide element is directly installed in the existing lock hole of the circuit board, since the insulating light guide element blocks between the circuit board and the screw, the circuit board lacks an effective grounding path so the static electricity of the circuit board cannot be successfully discharged and thus the static electricity accumulates and interferes in the normal operation of the circuit board so that the probability of damaging the circuit board is increased.

SUMMARY

The present disclosure provides an electronic device capable of effectively reducing the size of the circuit board and preventing the circuit board from accumulating static electricity.

An electronic device of the present disclosure includes a ground element, a conductive assembly, a circuit board, an insulating element and a conductive element. The conductive assembly includes a base and a screw element. The base is disposed at the ground element and contacts the ground element. The screw element has a fixing portion and a clamping portion connected to the fixing portion. The outer diameter of the clamping portion is larger than the outer diameter of the fixing portion, and the fixing portion is fixed to the base. The circuit board is disposed between the base and the clamping portion of the screw element. The insulating element is disposed between part of the clamping portion and the circuit board. The conductive element is disposed at the circuit board and contacts the conductive assembly, wherein the circuit board is electrically connected to the ground element through the conductive element and the conductive assembly.

In one embodiment of the present disclosure, the conductive element is in contact with the screw element of the conductive assembly, and the conductive element is electrically connected to the ground element through the screw element.

In one embodiment of the present disclosure, an orthographic projection of the conductive element onto the circuit board is located within an orthographic projection of the clamping portion of the screw element onto the circuit board.

In one embodiment of the present disclosure, the conductive element is in contact with the base of the conductive assembly, and the conductive element is electrically connected to the ground element through the base.

In one embodiment of the present disclosure, the clamping portion includes a first portion and a second portion connected to the first portion, the first portion is connected to the fixing portion, and the outer diameter of the second portion is larger than the outer diameter of the first portion.

In one embodiment of the present disclosure, the quantity of the insulating elements is two, and the two insulating elements are respectively disposed between the circuit board and the second portion and disposed between the circuit board and the base.

In one embodiment of the present disclosure, the insulating element has a first hole, the circuit board has a second hole, and the first hole and the second hole are stacked but have different sizes.

In one embodiment of the present disclosure, the first portion of the clamping portion is accommodated in the first hole, and the fixing portion is accommodated in the second hole.

In one embodiment of the present disclosure, the fixing portion is accommodated in the first hole, and at least a part of the base is accommodated in the second hole.

In one embodiment of the present disclosure, the insulating element is a light guiding element.

Based on the above, the present disclosure provides an electronic device, and the circuit board is connected to the ground through the conductive assembly, thereby preventing the circuit board from accumulating static electricity.

In order to make the aforementioned and other features and advantages of the present disclosure more comprehensible, embodiments accompanying figures are described in detail below.

BRIEF DESCRIPTION OF THE DRAWINGS

The accompanying drawings are included to provide a further understanding of the present disclosure, and are incorporated in and constitute a part of this specification. The drawings illustrate embodiments of the present disclosure and, together with the description, serve to explain the principles of the present disclosure.

DESCRIPTION OF THE EMBODIMENTS

Figure 1:
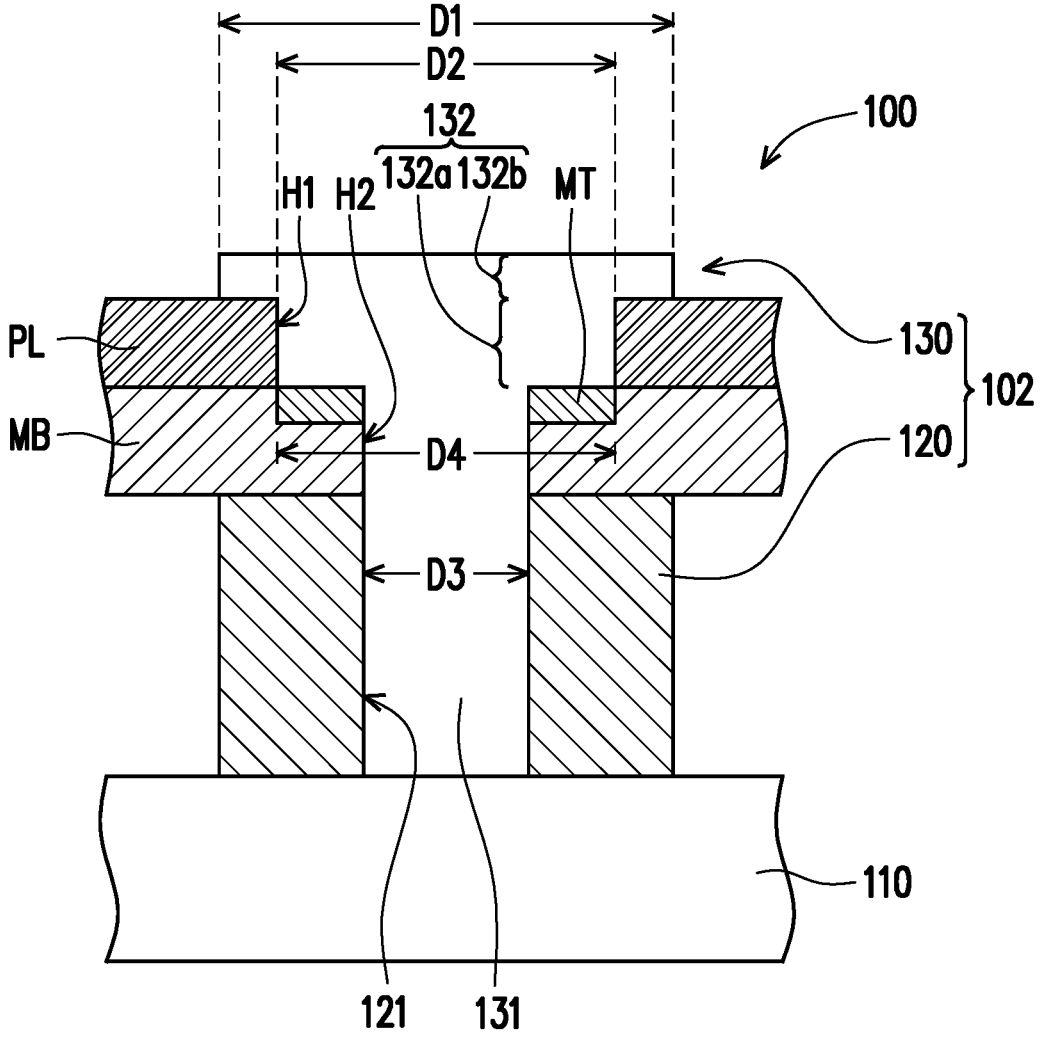
FIG. 1 is a schematic view of an electronic device according to one embodiment of the present disclosure.

FIG. 1 is a schematic view of an electronic device according to one embodiment of the present disclosure. FIG. 1 a cross-sectional view illustrating a part of a ground element 110, a part of the circuit board MB, and a part of the insulating element PL. Referring to FIG. 1, an electronic device 100 includes the ground element 110, a conductive assembly 102, the circuit board MB, the insulating element PL, and a conductive element MT.

More specifically, the conductive assembly 102 includes a base 120 and a screw element 130, and the base 120 is disposed at the ground element 110 and contacts the ground element 110. The screw element 130 has a fixing portion 131 and a clamping portion 132 connected to the fixing portion 131. The outer diameters D1 and D2 of the clamping portion 132 is larger than the outer diameter D3 of the fixing portion 131, and the fixing portion 131 is fixed to a lock hole 121 of the base 120.

To be more specific, the clamping portion 132 includes a first portion 132*a* and a second portion 132*b* connected to the first portion 132*a*, the first portion 132*a* is connected to the fixing portion 131, and the outer diameter D1 of the second portion 132*b* is larger than the outer diameter D2 of the first portion 132*a*. In other words, the first portion 132*a* of the clamping portion 132 is located between the fixing portion 131 and the second portion 132*b* of the clamping portion 132. The circuit board MB is disposed between the base 120 and the first portion 132*a* of the clamping portion 132. The insulating element PL is disposed between the second portion 132*b* of the clamping portion 132 and the circuit board MB. The conductive element MT is disposed at the circuit board MB and contacts the conductive assembly 102, wherein the circuit board MB is electrically connected to the ground element 110 through the conductive element MT and the conductive assembly 102. In the present embodiment, for example, the ground element 110 is an outer case made of metal, the conductive element MT is bare copper disposed at the circuit board MB. The material of the insulating element PL is plastic, for example, the insulating element PL may be a light guiding element made of plastic. When the circuit board MB generates static electricity, the static electricity can be conducted to the ground element 110 through the conductive element MT and the conductive assembly 102. Accordingly, the static electricity of the circuit board MB is effectively discharged, so the operation of the circuit board MB will not be affected due to the accumulation of static electricity.

To be more specific, the insulating element PL has a first hole H1, the circuit board MB has a second hole H2, the first hole H1 and the second hole H2 are stacked but have different sizes. In the present embodiment, the first hole H1 of the insulating element PL is larger than the second hole H2 of the circuit board MB as an example, but the present disclosure is not limited thereto. On the other hand, the circuit board MB leans against the base 120, the insulating element PL leans against the circuit board MB, the first portion 132*a* of the clamping portion 132 is accommodated in the first hole H1 of the insulating element PL, and a part of the fixing portion 131 is accommodated in the second hole H2 of the circuit board MB, the second portion 132*b* of the clamping portion 132 is located outside of the first hole H1, and the second portion 132*b* of the clamping portion 132 and the circuit board MB together clamp the insulating element PL therebetween. Because of this configuration, when the surface of the insulating element PL generates static electricity, static electricity is conducted to the ground element 110 through the screw element 130 and the base 120.

In the present embodiment, the conductive element MT is in contact with the screw element 130 of the conductive assembly 102. To be more specific, the conductive element MT is disposed between the circuit board MB and the first portion 132*a* of the clamping portion 132, and the conductive element MT is electrically connected to the ground element 110 through the screw element 130. In other words, the conductive element MT is disposed at a surface, which faces away from the ground element 110, of the circuit board MB.

When a surface relatively far away from the ground element 110 of the circuit board MB generates static electricity, the static electricity can pass through the conductive element MT and the screw element 130 and then to be conducted to the ground element 110, so as to prevent the components on the circuit board MB from being damaged due to the accumulated static electricity and to increase the lifetime of the circuit board MB.

In the present embodiment, the orthographic projection of the conductive element MT onto the circuit board MB is located within the orthographic projection of the clamping portion 132 of the screw element 130 onto the circuit board MB. In other words, the outer diameter D4 of the conductive element MT is not larger than the outer diameters D1 and D2 of the clamping portion 132, for example, the outer diameter D4 of the conductive element MT is not larger than the outer diameter D2 of the first portion 132*a* of the clamping portion 132, so as to create more space on the circuit board MB for wiring layout. On the other hand, when a surface close to the base 120 of the circuit board MB generates static electricity, the static electricity is conducted to the ground element 110 through the base 120, so a space which is used for disposing an additional conductive element MT on the surface close to the base 120 of the circuit board MB is saved. Therefore, the space occupied by the conductive element MT on the circuit board MB can be effectively reduced, so the space for wiring on the circuit board MB increases. As a result, the overall size of the circuit board MB can be effectively reduced so as to conform to the design trend toward lighter circuit board MB.

Figure 2:
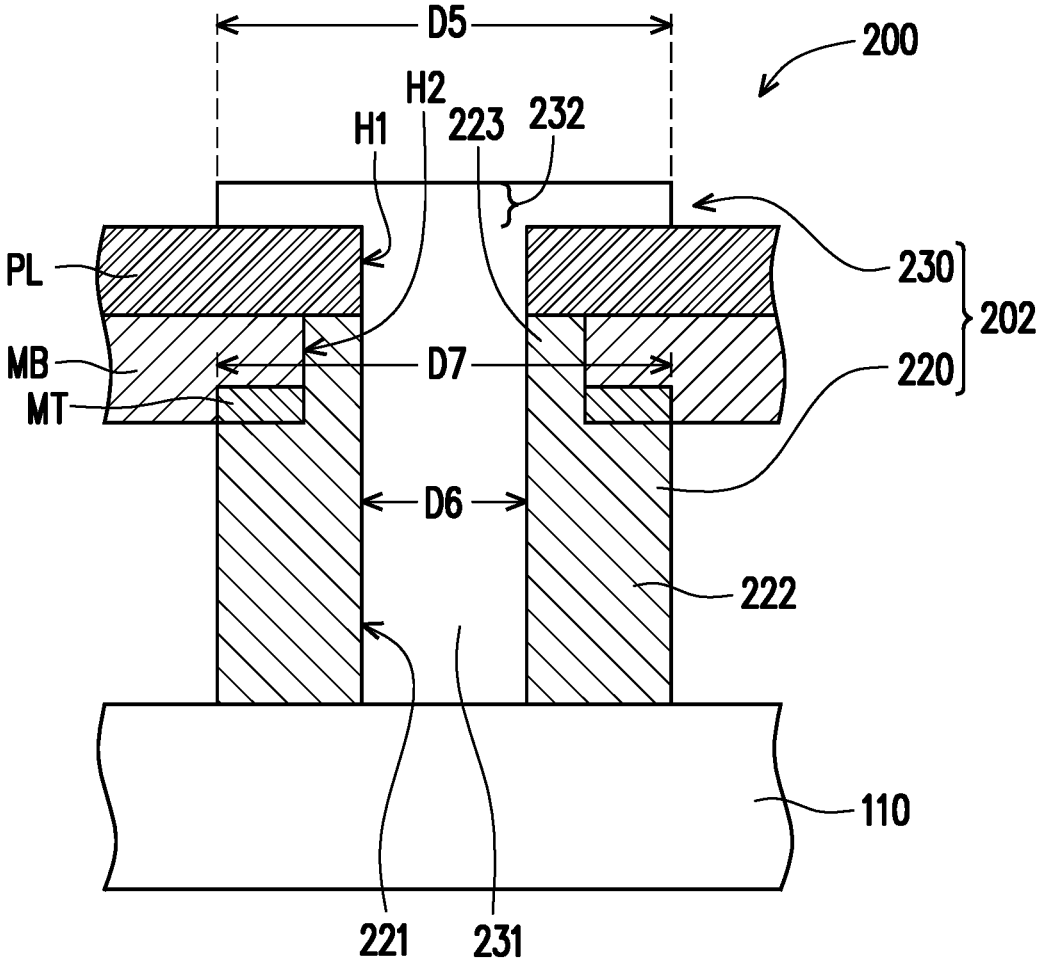
FIG. 2 is a schematic view of an electronic device according to another embodiment of the present disclosure.

FIG. 2 is a schematic view of an electronic device according to another embodiment of the present disclosure. Referring to FIG. 2, the components of an electronic device 200 that are the same or similar to the components in the previous embodiment have the same reference number, the details will not be repeated. In the present embodiment, a conductive assembly 202 includes a base 220 and a screw element 230, the base 220 includes a lock hole 221, a base body 222, and a positioning portion 223. The base body 222 is disposed at the ground element 110, the positioning portion 223 is connected to the base body 222, the lock hole 221 is located in the base body 222 and the positioning portion 223, and the ground element 110 and the positioning portion 223 are respectively located on two opposite sides of the base body 222.

In the present embodiment, the second hole H2 of the circuit board MB is larger than the first hole H1 of the insulating element PL, and the fixing portion 231 of the screw element 230 is accommodated in the first hole H1 and the positioning portion 223 of the base 220 is accommodated in the second hole H2. The conductive element MT is in contact with the base 220 of the conductive assembly 202.

To be more specific, the conductive element MT is disposed between the circuit board MB and the base body 222 of the base 220, the outer diameter D7 of the conductive element MT is larger than the outer diameter D5 of the clamping portion 232, and the conductive element MT is electrically connected to the ground element 110 through the base 220. Therefore, the circuit board MB is electrically connected to the ground element 110 through the conductive element MT and the base 220, so that static electricity is effectively discharged from the circuit board MB in order to prevent static electricity from accumulating and affecting the operation of the circuit board MB. In other words, the circuit board MB leans against a surface of the base body 222, so static electricity of the circuit board MB is successfully discharged through the conductive element MT and the ground element 110. Therefore, it prevents the components on the circuit board MB from being damaged due to the accumulated static electricity and to increase the lifetime of the circuit board MB.

On the other hand, the outer diameter D5 of the clamping portion 232 is larger than the outer diameter D6 of the fixing portion 231, and the clamping portion 232 of the screw element 230 and the circuit board MB together clamp the insulating element PL therebetween. When the surface of the insulating element PL generates static electricity, static electricity is conducted to the ground element 110 through the screw element 230 and the base 220, so as to successfully discharge static electricity.

In the present embodiment, the circuit board MB has the conductive element MT disposed at a surface close to the base 220 so the static electricity of the circuit board MB is successfully and smoothly discharged. Therefore, the space occupied by the conductive element MT on the circuit board MB can be effectively reduced, so the space for wiring on the circuit board MB increases. As a result, the overall size of the circuit board MB can be effectively reduced in order to conform to the design trend toward lighter circuit board MB.

Moreover, in the above-mentioned two embodiments of the present disclosure, the static electricity can still be effectively conducted to the ground element 110 regardless of which surface of the circuit board MB that the conductive element MT is disposed on, so the wiring layout of the circuit board MB is more flexible and has less restrictions.

Figure 3:
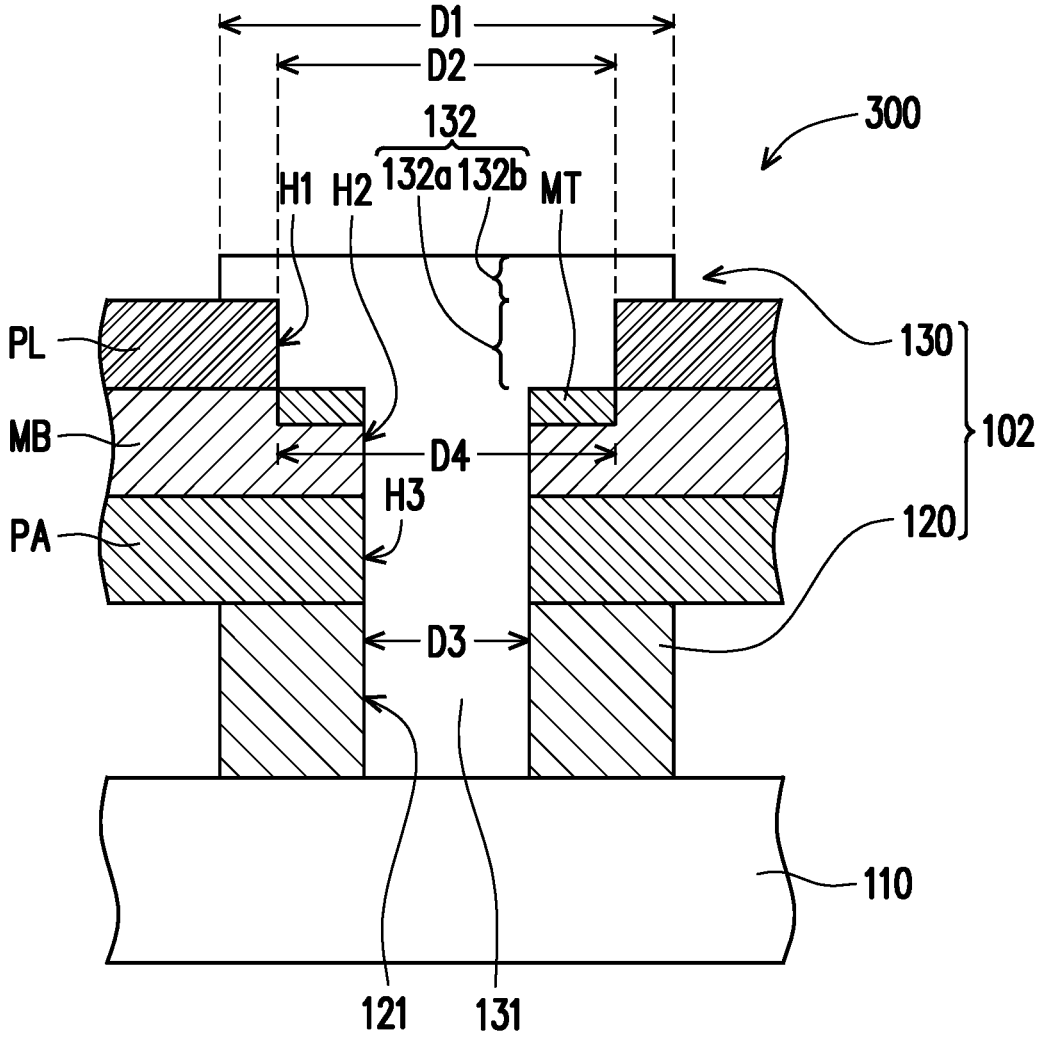
FIG. 3 is a schematic view of an electronic device according to yet another embodiment of the present disclosure.

FIG. 3 is a schematic view of an electronic device according to yet another embodiment of the present disclosure. In an electronic device 300 of FIG. 3, the configuration and the operation of the same elements are similar to the embodiment in FIG. 1, for example, the conductive element MT is the same with the conductive element MT in FIG. 1, the detail will not be repeated hereinafter. In the present embodiment, the quantity of the insulating elements in the electronic device 300 is two, an insulating element PL is disposed between the circuit board MB and the second portion 132*b* of the clamping portion 132, an insulating element PA is disposed between the circuit board MB and the base 120, the first portion 132*a* of the clamping portion 132 is accommodated in the first hole H1 of the insulating element PL, and the fixing portion 131 of the screw element 130 is accommodated in the second hole H2 of the circuit board MB and the third hole H3 of the insulating element PA.

When a surface, which is relatively far away from the ground element 110, of the circuit board MB generates static electricity, the static electricity is conducted to the ground element 110 through the conductive element MT and the screw element 130. The conductive element MT is located between the clamping portion 132 of the screw element 130 and the circuit board MB.

Therefore, even though the insulating element PA is additionally disposed between the circuit board MB and the ground element 110, the surface, which is relatively far away from the ground element 110, of the circuit board MB can still be electrically connected to the ground element 110 through the screw element 130, so as to prevent the circuit board MB from accumulating static electricity. Therefore, it prevents the components on the circuit board MB from being damaged due to the accumulated static electricity and to increase the lifetime of the circuit board MB.

Summarily, in the electronic device of the present disclosure, the circuit board can effectively discharge static electricity, so as to prevent the components on the circuit board MB from being damaged due to the accumulated static electricity and to increase the lifetime of the circuit board MB. Moreover, the static electricity on surface of the circuit board can still be effectively conducted to the ground element regardless of which surface of the circuit board that the conductive element is disposed on, so the wiring layout of the circuit board is more flexible and has less restrictions.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electronic device, comprising:

a ground element;

a conductive assembly, wherein the conductive assembly comprises:

a base, disposed at the ground element and contacting the ground element; and a screw element, having a fixing portion and a clamping portion connected to the fixing portion, wherein an outer diameter of the clamping portion is larger than an outer diameter of the fixing portion, and the fixing portion is fixed to the base;

a circuit board, disposed between the base and the clamping portion of the screw element;

an insulating element, disposed between part of the clamping portion and the circuit board, wherein the clamping portion comprises a first portion and a second portion connected to the first portion, the first portion is connected to the fixing portion, and an outer diameter of the second portion is larger than an outer diameter of the first portion; and a conductive element, disposed at the circuit board and contacting the conductive assembly, wherein the circuit board is electrically connected to the ground element through the conductive element and the conductive assembly.

2. The electronic device as recited in claim 1, wherein the conductive element is in contact with the screw element of the conductive assembly, and the conductive element is electrically connected to the ground element through the screw element.

3. The electronic device as recited in claim 1, wherein an orthographic projection of the conductive element onto the circuit board is located within an orthographic projection of the clamping portion of the screw element onto the circuit board.

4. The electronic device as recited in claim 1, wherein the conductive element is in contact with the base of the conductive assembly, and the conductive element is electrically connected to the ground element through the base.

5. The electronic device as recited in claim 1, wherein a quantity of the insulating elements is two, one of the insulating elements is disposed between the circuit board and the second portion and the other one of the insulating elements is disposed between the circuit board and the base.

6. The electronic device as recited in claim 1, wherein the insulating element has a first hole, the circuit board has a second hole, the first hole and the second hole are stacked but have different sizes.

7. The electronic device as recited in claim 6, wherein the first portion of the clamping portion is accommodated in the first hole, and the fixing portion is accommodated in the second hole.

8. The electronic device as recited in claim 6, wherein the fixing portion is accommodated in the first hole, and at least a part of the base is accommodated in the second hole.

9. The electronic device as recited in claim 1, wherein the insulating element is a light guiding element.

* * * * *